US011105121B2

(12) United States Patent
Rai et al.

(10) Patent No.: US 11,105,121 B2
(45) Date of Patent: Aug. 31, 2021

(54) RUGGED CREDENTIAL INPUT ASSEMBLIES

(71) Applicant: Schlage Lock Company LLC, Carmel, IN (US)

(72) Inventors: Subashchandra G. Rai, Bangalore (IN); Taukeer Ansari, Bihar (IN); Jineesh Kunnoth, Bangalore (IN); Vishwas N. Moolimani, Bangalore (IN)

(73) Assignee: Schlage Lock Company LLC, Carmel, IN (US)

( * ) Notice: Subject to any disclaimer, the term of this patent is extended or adjusted under 35 U.S.C. 154(b) by 352 days.

(21) Appl. No.: 16/275,930

(22) Filed: Feb. 14, 2019

(65) Prior Publication Data

US 2020/0263449 A1 Aug. 20, 2020

(51) Int. Cl.

| | |
|---|---|
| ***E05B 47/00*** | (2006.01) |
| ***E05B 47/06*** | (2006.01) |
| ***E05B 17/00*** | (2006.01) |
| ***G07C 9/00*** | (2020.01) |

(52) U.S. Cl.

CPC ..... *E05B 47/0001* (2013.01); *E05B 17/0083* (2013.01); *E05B 17/0087* (2013.01); *E05B 47/0657* (2013.01); *G07C 9/00571* (2013.01); *E05Y 2900/132* (2013.01)

(58) Field of Classification Search

CPC ..... G07C 9/00571; E05B 9/00571

See application file for complete search history.

(56) References Cited

U.S. PATENT DOCUMENTS

| | | | | |
|---|---|---|---|---|
| 8,136,736 | B2 * | 3/2012 | Couck | G06K 19/041 235/492 |
| 9,024,759 | B2 * | 5/2015 | Uyeda | E05B 47/06 340/542 |
| 9,530,264 | B2 * | 12/2016 | Caterino | H04N 7/186 |
| 9,852,564 | B2 * | 12/2017 | Henderson | G07C 9/00563 |
| 10,465,422 | B2 * | 11/2019 | Ullrich | E05B 1/0007 |

* cited by examiner

*Primary Examiner* — K. Wong

(74) *Attorney, Agent, or Firm* — Taft Stettinius & Hollister LLP

(57) ABSTRACT

An exemplary credential input device includes a mounting plate, a pivot pad, a sensor, an input device, and a controller. The pivot pad is pivotably mounted to the mounting plate, is biased to a home position, and is operable to pivot to each of a plurality of pivoted positions. The sensor is mounted to the pivot pad such that the sensor moves with the pivot pad, and is configured to generate information relating to an orientation of the sensor. The input device operable to move the pivot pad from the home position to each of the plurality of pivoted positions, thereby altering the orientation of the sensor. The controller is in communication with the sensor, and is configured to determine an inputted code based upon information received from the sensor, to compare the inputted code to an authorized code, and to issue a command in response to the comparing.

20 Claims, 8 Drawing Sheets

RUGGED CREDENTIAL INPUT ASSEMBLIES

TECHNICAL FIELD

The present disclosure generally relates to access control devices, and more particularly but not exclusively relates to rugged credential input assemblies and access control devices comprising the same.

BACKGROUND

Electronic access control devices are frequently installed to doors and other devices to restrict access to locations, objects, or electronic information. Certain such devices include a credential input device by which a user can input a credential, such as a code or gesture. One commonly-used credential input device is a keypad by which the user inputs a personal identification number (PIN) or a passcode. Depending on the manner in which the access control device is utilized, the input device may be subjected to adverse environmental conditions. For example, a keypad installed to an external door may be subjected to vandalism and/or harsh weather conditions, such as precipitation, extreme temperatures and salt fog.

Many conventional credential input devices are susceptible to damage inflicted by the above-mentioned conditions. For example, many conventional keypads require several seals to protect the internal components from the elements. However, such seals are subject to degradation, particularly when the seals are provided to moving components. For these reasons among others, there remains a need for further improvements in this technological field.

SUMMARY

An exemplary credential input device includes a mounting plate, a pivot pad, a sensor, an input device, and a controller. The pivot pad is pivotably mounted to the mounting plate, is biased to a home position, and is operable to pivot to each of a plurality of pivoted positions. The sensor is mounted to the pivot pad such that the sensor moves with the pivot pad, and is configured to generate information relating to an orientation of the sensor. The input device operable to move the pivot pad from the home position to each of the plurality of pivoted positions, thereby altering the orientation of the sensor. The controller is in communication with the sensor, and is configured to determine an inputted code based upon information received from the sensor, to compare the inputted code to an authorized code, and to issue a command in response to the comparing. Further embodiments, forms, features, and aspects of the present application shall become apparent from the description and figures provided herewith.

DETAILED DESCRIPTION OF ILLUSTRATIVE EMBODIMENTS

Figure 1:
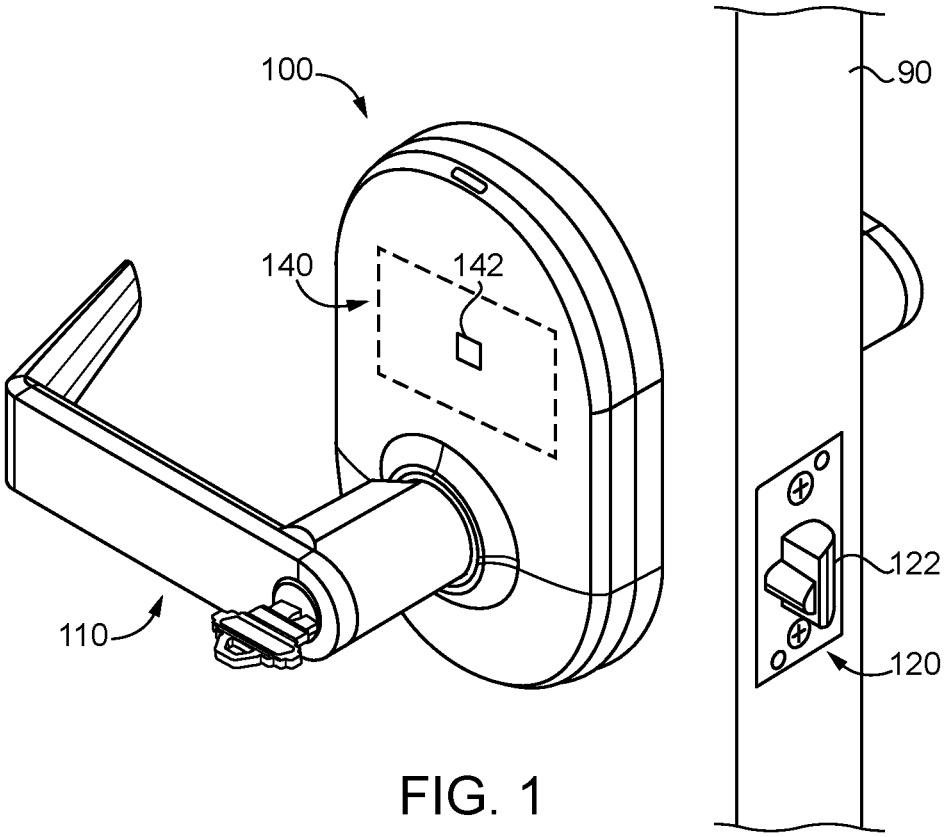
FIG. 1 is a perspective illustration of an access control device according to certain embodiments.

Although the concepts of the present disclosure are susceptible to various modifications and alternative forms, specific embodiments have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. It should further be appreciated that although reference to a "preferred" component or feature may indicate the desirability of a particular component or feature with respect to an embodiment, the disclosure is not so limiting with respect to other embodiments, which may omit such a component or feature. Further, when a particular feature, structure, or characteristic is described in connection with an embodiment, it is submitted that it is within the knowledge of one skilled in the art to implement such feature, structure, or characteristic in connection with other embodiments whether or not explicitly described.

Additionally, it should be appreciated that items included in a list in the form of "at least one of A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C). Further, with respect to the claims, the use of words and phrases such as "a," "an," "at least one," and/or "at least one portion" should not be interpreted so as to be limiting to only one such element unless specifically stated to the contrary, and the use of phrases such as "at least a portion" and/or "a portion" should be interpreted as encompassing both embodiments including only a portion of such element and embodiments including the entirety of such element unless specifically stated to the contrary.

In the drawings, some structural or method features may be shown in certain specific arrangements and/or orderings. However, it should be appreciated that such specific arrangements and/or orderings may not be required. Rather, in some embodiments, such features may be arranged in a different manner and/or order than shown in the illustrative figures unless indicated to the contrary. Additionally, the inclusion of a structural or method feature in a particular figure is not meant to imply that such feature is required in all embodiments and, in some embodiments, may not be included or may be combined with other features.

The disclosed embodiments may, in some cases, be implemented in hardware, firmware, software, or a combination thereof. The disclosed embodiments may also be implemented as instructions carried by or stored on one or more transitory or non-transitory machine-readable (e.g., computer-readable) storage media, which may be read and executed by one or more processors. A machine-readable storage medium may be embodied as any storage device, mechanism, or other physical structure for storing or transmitting information in a form readable by a machine (e.g., a volatile or non-volatile memory, a media disc, or other media device).

Figure 2:
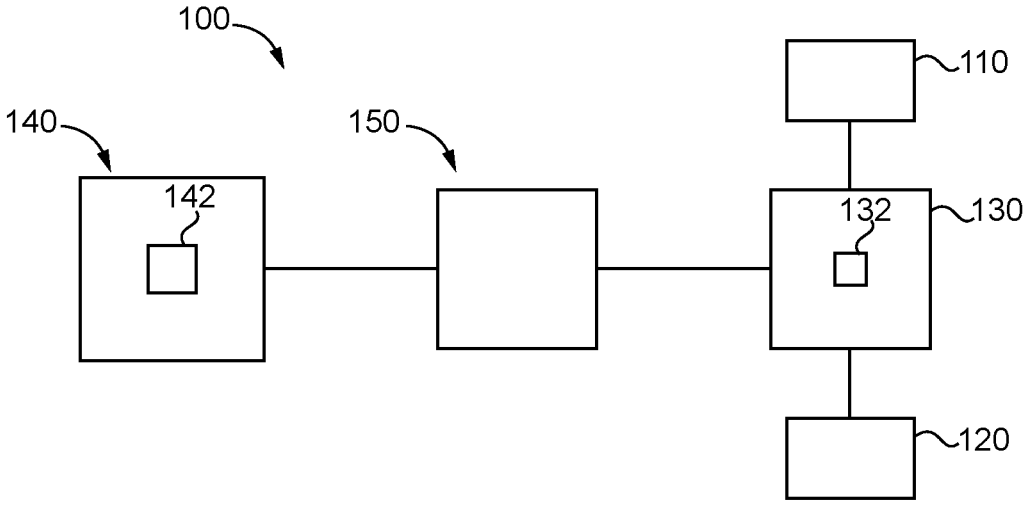
FIG. 2 is a schematic block diagram of the access control device illustrated in FIG. 1.

With reference to FIGS. 1 and 2, illustrated therein is an access control device 100 according to certain embodiments. The access control device 100 includes a manual actuator 110, a bolt mechanism 120, and an electronic actuator 130 that controls the locked/unlocked state of the access control device 100, for example by selectively permitting the manual actuator 110 to actuate the bolt mechanism 120. The access control device 100 further includes a credential input device 140 including a sensor 142, and a controller 150 in communication with the credential input device 140 and the electronic actuator 130.

In the illustrated form, the manual actuator 110 is selectively connected to the bolt mechanism 120 by the electronic actuator 130. The bolt mechanism 120 includes a bolt 122 having an extended position and a retracted position. When connected to the bolt mechanism 120, the manual actuator 110 is operable to move the bolt 122 from the extended position to the retracted position to facilitate opening of a door 90. In other embodiments, the manual actuator 110 may not necessarily be connected to the bolt mechanism 120.

During operation of the access control device 100, a user inputs a code using the credential input device 140, and the inputted code is detected by the sensor 142 and the controller 150. As described herein, the credential input device 140 may, for example, take the form of a keypad or a joystick. The controller 140 compares the inputted code to an authorized code, and makes decisions based upon the comparing. More particularly, if the inputted code matches the authorized code, the controller 140 issues an unlock command to the electronic actuator 130, thereby causing the electronic actuator 130 to transition the access control device 100 from a locked condition to an unlocked condition.

In certain forms, the locked/unlocked condition of the access control device may be defined by the operability of the manual actuator 110 to move the bolt 122 from its extended position to its retracted position. More particularly, the access control device 100 may have an unlocked condition in which the manual actuator 110 is operable to retract the bolt 122 and a locked condition in which the manual actuator 110 is inoperable to retract the bolt 122. In such forms, the electronic actuator 130 may transition the access control device 100 between the locked condition and the unlocked condition by moving a locking member 132 between a locking position in which the locking member 132 prevents the manual actuator 110 from actuating the bolt mechanism 120 and an unlocking position in which the locking member 132 permits actuation of the bolt mechanism 120. As one example, the locking member 132 may selectively prevent the manual actuator 110 from rotating, thereby selectively preventing the manual actuator 110 from retracting the bolt 122. As another example, the locking member 132 may selectively couple the manual actuator with the bolt mechanism 120 to selectively permitting the manual actuator 110 to retract the bolt 122.

In other embodiments, the locked/unlocked condition of the access control device may be defined by the extended/retracted position of the bolt 122. More particularly, the access control device 100 may have an unlocked condition in which the bolt 122 is retracted and a locked condition in which the bolt 122 is extended. In such forms, the electronic actuator 130 may transition the access control device 100 between the locked condition and the unlocked condition by moving the bolt 122 between its extended and retracted positions. In such forms, the bolt 122 may be considered to constitute the locking member 132.

Described herein are various embodiments of credential input devices that may be utilized as the credential input device 140. While the illustrated access control device 100 is provided in the form of a door lock, it is to be appreciated that the credential input devices described herein may be utilized in combination with access control devices of other types. As one example, such an access control device may take the form of a portable lock, such as a padlock or a lockbox. Alternatively, the credential input devices described herein may be utilized to control access to digital information, or in combination with any other form of access control device that can utilize a credential input device of the types described herein.

Figure 3:
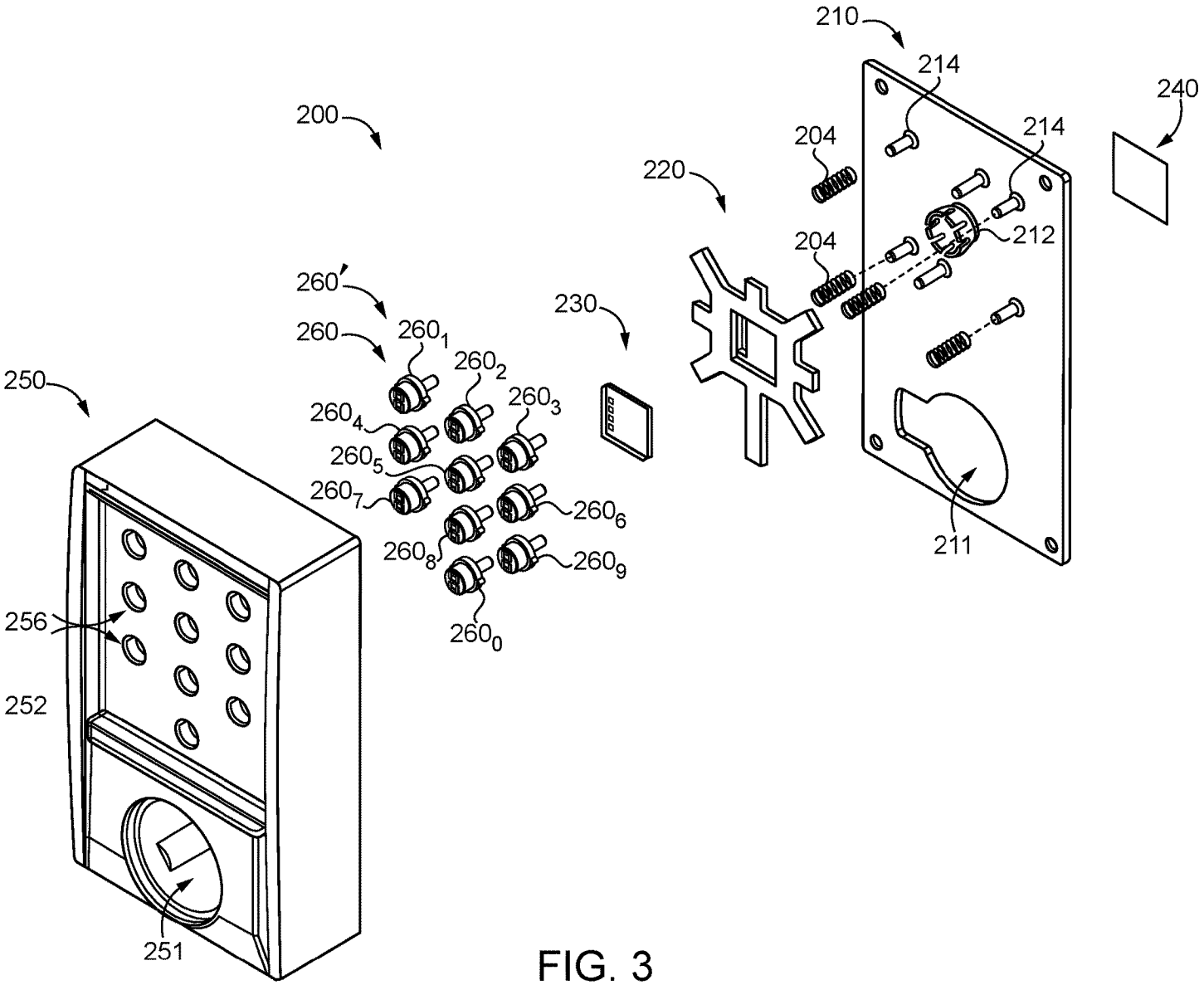
FIG. 3 is an exploded assembly view of a keypad assembly according to certain embodiments.

With additional reference to FIG. 3, illustrated therein is a credential input device that may, in certain forms, be utilized as the credential input device 140 of the access control device 100. More particularly, FIG. 3 illustrates a keypad assembly 200 that generally includes a mounting plate 210, a pivot pad 220 pivotably mounted to the mounting plate 210, a sensor 230 mounted to the pivot pad 220, a controller 240 in communication with the sensor 230, a housing 250 mounted to the mounting plate 210, and user input device 260' including a plurality of keys 260 movably mounted to the housing 240.

The illustrated mounting plate 210 is configured for mounting to a door, and includes an opening 211 through which the manual actuator 110 can extend to engage the bolt mechanism 120. The mounting plate 210 further includes a socket 212 to which the pivot pad 220 is pivotably mounted, and a plurality of posts 214 positioned about the socket 212. A plurality of springs 204 are mounted to the posts 214 and bias the pivot pad 220 to a home position.

Figure 4:
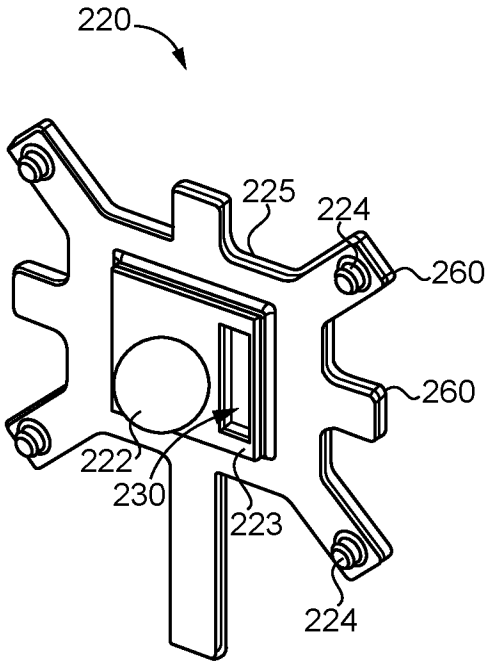
FIG. 4 is a perspective view of a pivot pad of the keypad assembly illustrated in FIG. 3.

With additional reference to FIG. 4, the pivot pad 220 includes a ball 222 that is received in the socket 212 to form a ball and socket joint such that the pivot pad 220 is pivotably supported by the mounting plate 210. While the illustrated ball and socket joint includes a socket 212 formed by the mounting plate 210 and a ball 222 defined by the pivot pad 220, it is to be appreciated that this configuration may be reversed. The pivot pad 220 further includes a pad portion 225 defining a recess 223 in which the sensor 230 is seated, and in the illustrated form includes a plurality of arms 226 operable to engage the keys 260. The rear side of the pivot pad 220 includes a plurality of posts 224 that align with the posts 214 of the mounting plate 210. A plurality of springs 204 are mounted to the posts 214, 224, and bias the pivot pad 220 to a home position. While other orientations are contemplated, in the illustrated form, the home position of the pivot pad 220 is one in which the pivot pad 220 is vertical.

The sensor 230 is in communication with the controller 240, and is configured to transmit to the controller 240 information relating to the current orientation of the sensor 230. With the sensor 230 mounted to the pivot pad 220, the orientation of the sensor 230 corresponds to that of the pivot pad 220. Thus, the controller 240 is operable to determine the current orientation of the pivot pad 220 based upon the information received from the sensor 230. In the illustrated form, the sensor 230 is provided as a multi-axis gyrometer. It is also contemplated that the sensor 230 may be provided in another form, such as that of an accelerometer. As will be appreciated, the controller 240 may be in communication with an electronic actuator, for example in the manner the controller 150 is in communication with the actuator 130 as described above.

Figure 5:
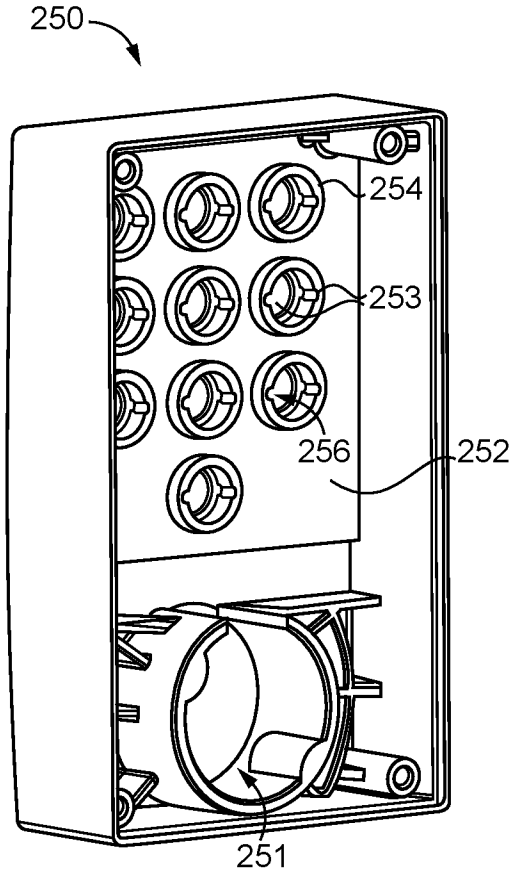
FIG. 5 is a perspective view of a housing of the keypad assembly illustrated in FIG. 3.

With additional reference to FIG. 5, the housing 250 includes a faceplate 252 having a plurality of openings 256, each of which has a corresponding and respective key 260 mounted therein. The housing 250 may be constructed of metal, and further includes an opening 251 in which the manual actuator 110 may be mounted. Formed on the reverse side of the faceplate 252 are a plurality of collars 254, each of which is positioned about a corresponding and respective one of the openings 256 and includes one or more recesses 253.

Figure 6:
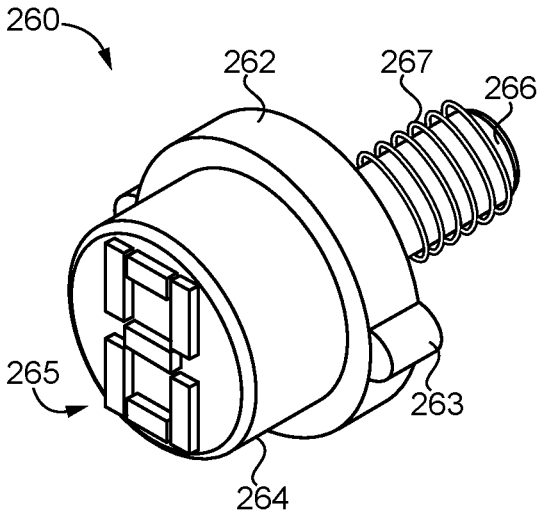
FIG. 6 is a perspective view of a key of the keypad assembly illustrated in FIG. 3.

With additional reference to FIG. 6, each key 260 includes a base 262, a body 264 extending from the base 262 in one direction, and a post 266 extending from the base 262 in the opposite direction and toward the pivot pad 220. Each key 260 is movably mounted to the housing 250 for movement between a projected position and a depressed position, and each key 260 is biased toward its projected position. For example, a spring 267 may be mounted to the post 266 and engaged with the pivot pad 220 to bias the key 260 toward its projected position. The body 264 of each key 260 extends through a corresponding and respective opening 256 in the housing 250 such that the body 264 can be manually depressed by a user seeking to enter a code. In the illustrated form, the keys 260 are generally circular in cross-section, and include splines 263 that fit in the recesses 253 to prevent rotation of the keys 260. It is also contemplated that the splines 263 may be omitted, for example in the event that the keys 260 and collars 254 have a non-circular cross-section or include another mechanism for preventing unwanted rotation of the keys 260.

The base 262 has a greater width dimension than the body 264 such that the spring 267 urges the base 262 into contact with the rear surface of the faceplate 252, thereby back-loading the key 260. As used herein, the term "back-loaded" indicates that the rear side of the key 260 is larger than the opening 254 in which the key 260 is mounted such that the key 260 cannot be removed from the front side of the housing 250. In addition to providing the key 260 with a positive stop at the projected position thereof, this back-loading aids in preventing the key 260 from being plucked out of the opening 256 by vandals. The keys 260 may be constructed of metal to further improve vandal resistance.

Each key 260 further includes one or more indicia 265 formed on the visible surface of the body 264. By way of example, the indicia 265 may comprise alphanumeric indicia. In the illustrated form, the plurality of keys 260 include indicia 265 that number the keys 260 from zero to nine, and the descriptions that follow will make reference to numbered keys ranging from a zero key $\mathbf{260}_0$ to a nine key $\mathbf{260}_9$. It is to be appreciated, however, that the keys 260 may be labeled with additional or alternative indicia, and that more or fewer keys 260 may be utilized.

Figure 7:
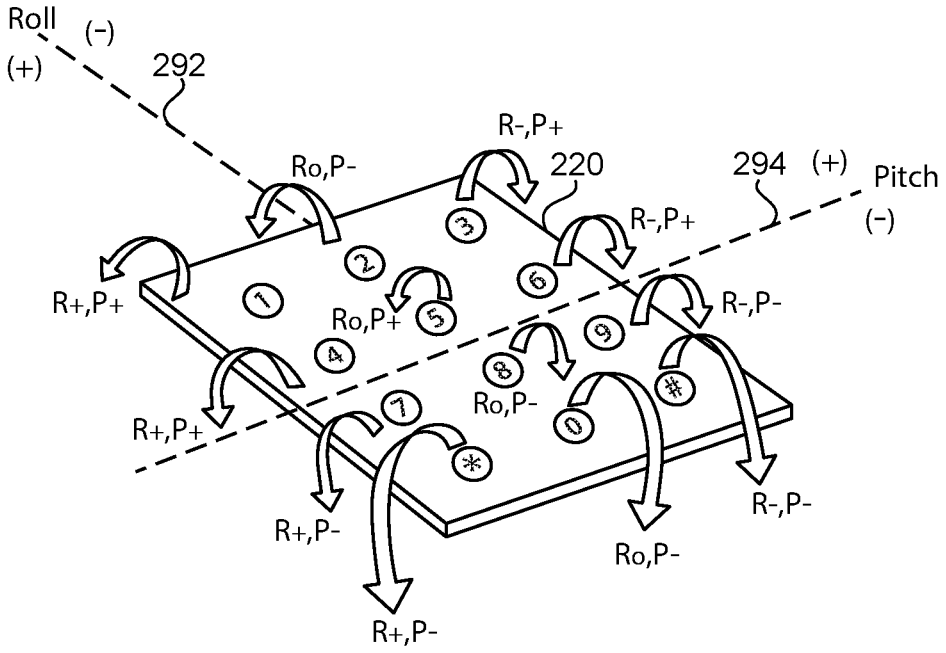
FIG. 7 is a schematic representation of the pivot pad illustrated in FIG. 4 during operation of the keypad assembly.

With additional reference to FIG. 7, illustrated therein is a schematic representation of the pivot pad 220 during operation of the keypad assembly 200, which is illustrated along with exemplary points of contact for the various keys 260. The ball and socket joint provided by the ball 222 and socket 212 facilitate pivoting of the pivot pad 220 about two axes, labeled in FIG. 7 as a roll axis 292 and a pitch axis 294. When one of the keys 260 is pressed, the post 266 thereof engages the pivot pad 220 and drives the pivot pad 220 to a pivoted position against the biasing force of the springs 204. For example, depressing the one key $\mathbf{260}_1$ pivots the pad 220 to a roll-positive, pitch-positive ($R_+$, $P_+$) orientation, whereas depressing the nine key $\mathbf{260}_9$ pivots the pad 220 to a roll-negative, pitch-negative ($R_-$, $P_-$) orientation. While certain keys may provide similar orientations as one another, the degree of pitch and/or roll may be utilized to distinguish between similar orientations. For example, while the eight key $\mathbf{260}_8$ and the zero key $\mathbf{260}_0$ may both provide the pad 220 with a roll-neutral, pitch-negative ($R_0$, $P_-$) orientation, the negative pitch degree will be different for the eight key $\mathbf{260}_8$ and the zero key $\mathbf{260}_0$ due to the positional differences between the keys 260.

In light of the foregoing, it should be evident that the controller 240 is capable of interpreting the information from the sensor 230 to determine the orientation of the pivot pad 220, and to thereby determine which key 260 has been pressed. The controller 240 therefore can compare the entered code to one or more authorized codes, and make decisions based upon the comparing. For example, if the inputted code matches an authorized code, the controller 240 may operate the electronic actuator 130 to unlock the access control device. If the inputted code does not match an authorized code, the controller 240 may activate a feedback mechanism, such as an audible or visual alert.

The illustrated keypad mechanism 200 may provide for certain advantages over existing keypads, such as those related to resistance to adverse environmental conditions. For example, the use of a single moving component (i.e., the sensor 230) to detect the manipulation of all keys 260 may reduce the number and complexity of the seals required to protect the electronic components of the access control device 100. Additionally, the detection of input relies upon the orientation of the sensor 230, as opposed to tactile input such as closing a switch. As such, the sensor 230 can be potted to the pad 220 to further increase its weather-resistance.

In the illustrated embodiment, the user input device 260' is provided in the form of a plurality of keys 260. It is also contemplated that the user input device 260' may be provided in another form. For example, FIG. 8 illustrates a portion of a credential input device in the form of a joystick assembly 300 according to certain embodiments.

Figure 9:
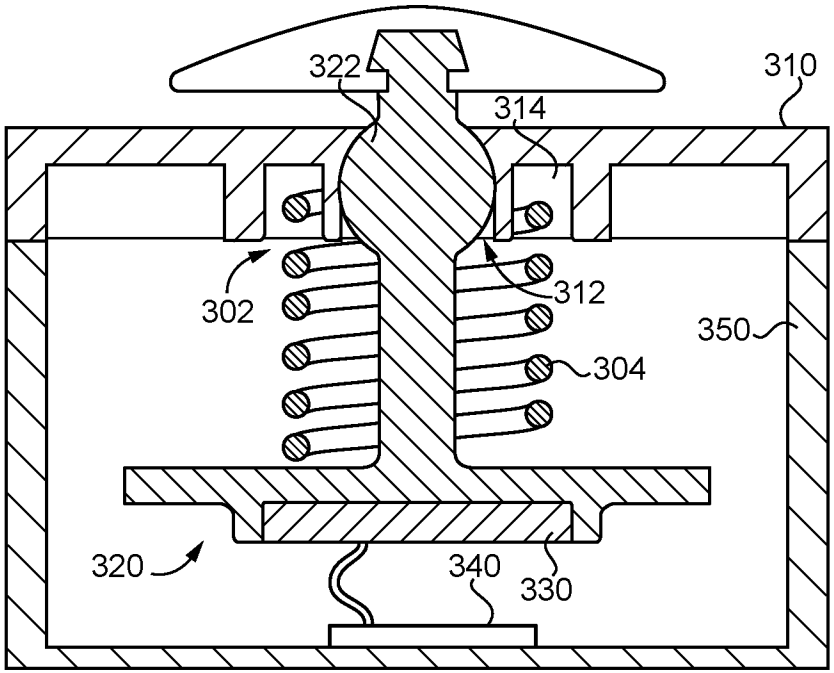
FIG. 9 is a cross-sectional illustration of the joystick assembly illustrated in FIG. 8.
Figure 8:
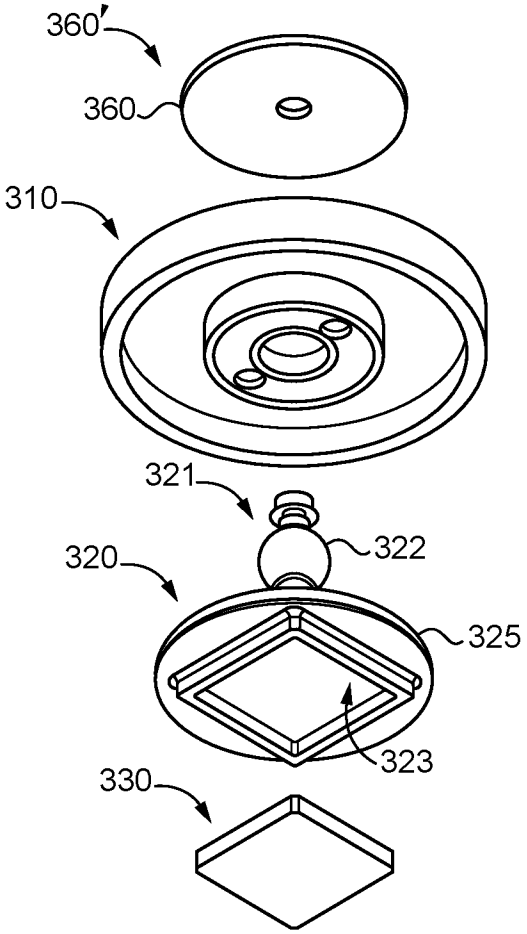
FIG. 8 is an exploded assembly view of a joystick assembly according to certain embodiments.

With reference to FIGS. 8 and 9, illustrated therein is a joystick assembly 300 according to certain embodiments. The joystick assembly 300 is somewhat similar to the keypad assembly 200, and similar elements and features are indicated with similar reference characters. For example, the joystick assembly 300 includes a mounting plate 310, a pivot pad 320, a sensor 330, a controller 340, a housing 350, and a user input device 360', which respectively correspond to the mounting plate 210, the pivot pad 220, the sensor 230, the controller 240, the housing 250, and the user input device 260'. In the interest of conciseness, the following description focuses primarily on elements and features of the joystick assembly 300 that are different from those described above with reference to the keypad assembly 200.

The mounting plate 310 defines the front of the joystick assembly 300, and includes an open socket 312 that extends through the thickness of the mounting plate 310. An annular channel 314 is defined about the socket 312, and defines a mounting location for a spring 304 that biases the pivot pad 320 toward its home position.

The pivot pad 320 includes a pad portion 325 having a stem 321 extending therefrom, and the stem 321 includes an enlarged portion that defines the ball 322 of a ball and socket joint 302. The pad portion 325 is formed on one end of the stem 321 and is positioned within the housing 350. The stem 321 extends through the open socket 312 such that the opposite second end of the stem 321 is positioned outside the housing 250, and the user input device 360' is provided as a platform 360 mounted to the second end of the stem 321. The platform 360 and the pivot pad 320 thus cooperate to define a joystick-like structure that is operable to pivot the sensor 330 between its home position and a plurality of pivoted positions.

During operation of the joystick assembly 300, the user may input a code by manually moving the platform 360. The pivotal movement of the platform 360 causes a corresponding but opposite movement of the sensor 330. For example, pivoting the platform 360 to the right causes a corresponding pivoting of the sensor 330 to the left, whereas pivoting of the platform 360 in a forward direction causes a corresponding pivoting of the sensor 330 in a rearward direction. As a result, that the controller 340 is capable of distinguishing between the various directions in which the platform 360 can be pivoted, and is therefore capable of determining a code input by the user (e.g., RIGHT, LEFT, UP) based upon the information generated by the sensor 330.

Figure 10:
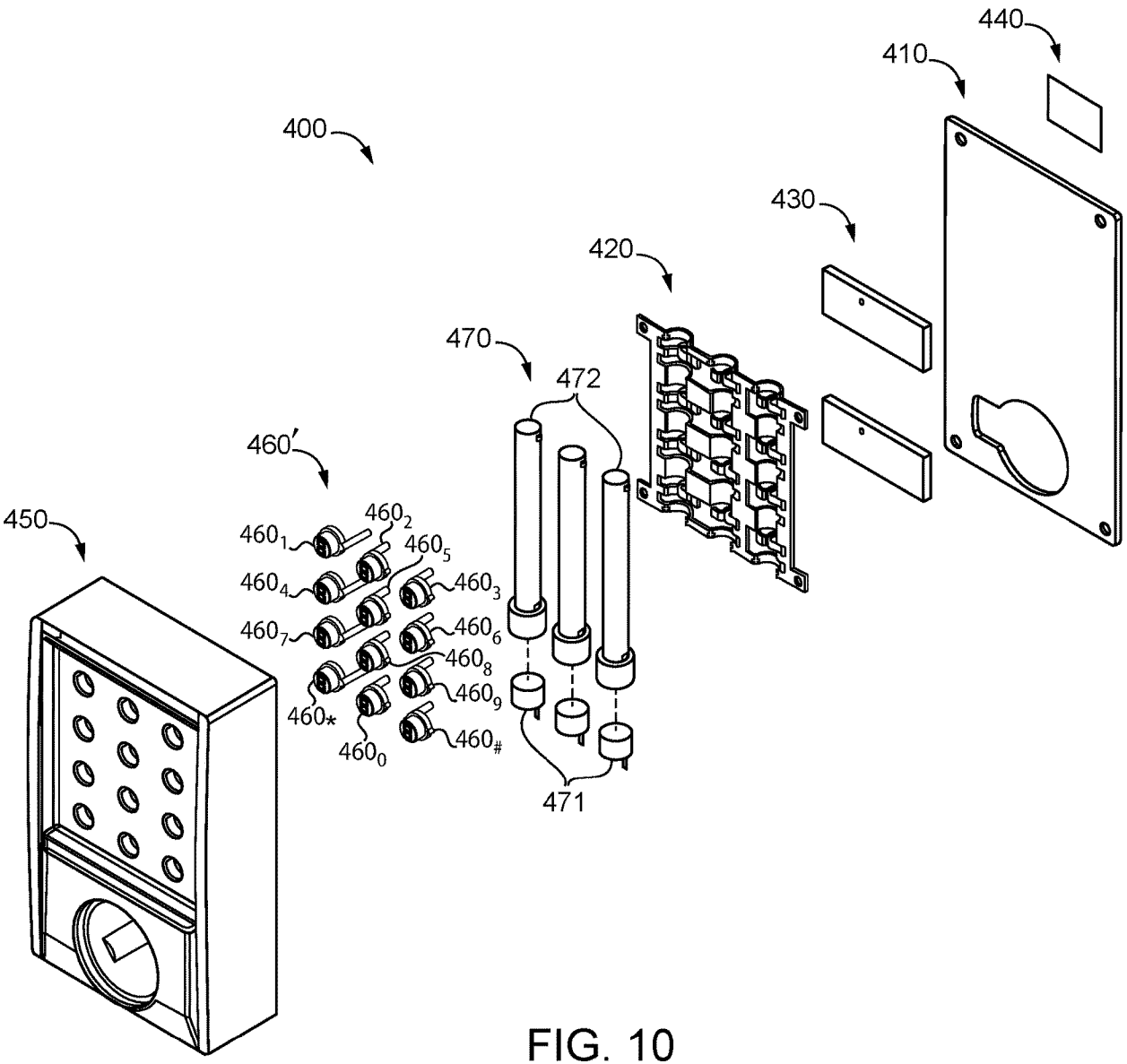
FIG. 10 is an exploded assembly view of a keypad assembly according to certain embodiments.

With reference to FIG. 10, illustrated therein is a keypad assembly 400 according to certain embodiments. The keypad assembly 400 generally includes a mounting plate 410, a flex pad 420 mounted to the mounting plate 410, a sensor 430 mounted between the flex pad 420 and the mounting plate 410, a controller 440 in communication with the sensor 430, a housing 450 mounted to the mounting plate 410, a user input device 460' including a plurality of keys 460 movably mounted to the housing 450 and engaged with the flex pad 420, and a sound generating assembly 470 in communication with the controller 440. The sound generating assembly 470 includes at least one pipe 472 having a speaker 471 mounted therein, and in the illustrated form includes a plurality of pipes 472, each having a speaker 471 mounted therein. The housing 450 and the keys 460 are substantially similar to the above-described housing 250 and keys 260, and similar reference characters are used to indicate similar elements and features.

Figure 12:
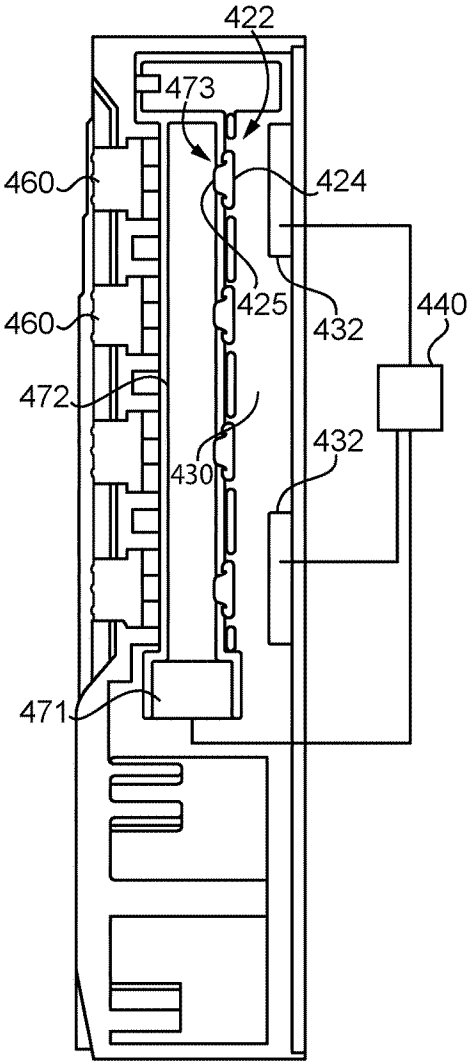
FIG. 12 is a cross-sectional illustration of the keypad assembly illustrated in FIG. 10.
Figure 11:
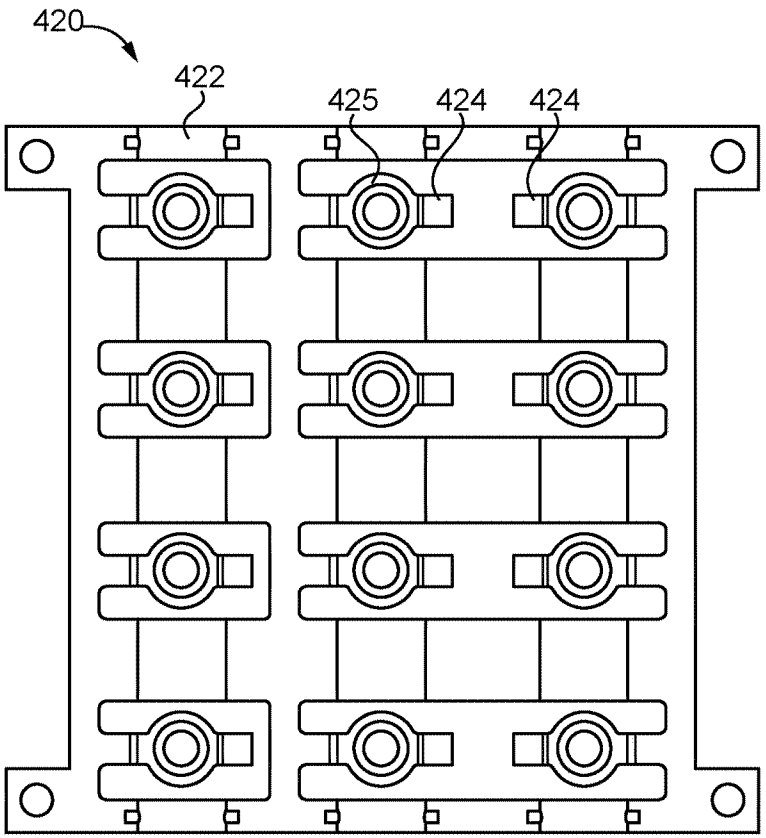
FIG. 11 is a plan view of a flex pad of the keypad assembly illustrated in FIG. 10.

With additional reference to FIGS. 11 and 12, the flex pad 420 includes a plurality of troughs 422, each of which has a corresponding one of the pipes 472 seated therein. The flex pad 420 further includes a plurality of resilient flaps 424, each of which projects into a corresponding one of the troughs 422. The end of each flap 424 is operable to be engaged by the post 466 of a corresponding one of the keys 460. Thus, each flap 424 has a home position corresponding to the projected position of the corresponding key 460, and a flexed position corresponding to the depressed position of the corresponding key 460. Each pipe 472 includes a plurality of apertures 473, and each resilient flap 424 includes a protrusion 425 that blocks a corresponding one of the apertures 473 when the flap 424 is in its home position. Thus, the home position of the flap 424 may alternatively be referred to as a closed position, and the flexed position of the flap 424 may alternatively be referred to as an open position.

In the illustrated form, the apertures 473 are selectively blocked by the flaps 424, the resiliency of which bias the flaps 424 toward the closed position. It is also contemplated that the flaps 424 may be biased toward the open position, and that depression of the corresponding key 460 may move the flap 424 toward its closed position. In further embodiments, the flex pad 420 may be omitted, and the flaps 424 may be formed on the keys 460 themselves.

Each speaker 471 is mounted within a corresponding pipe 472, and is in communication with the controller 440. During operation of the keypad assembly 400, each speaker 471 emits a sound having an amplitude and a frequency, each of which frequencies is preferably outside the range of normal human hearing (i.e., ultrasonic or infrasonic). The sensor 430 includes at least one microphone 432, and in the illustrated form includes a plurality of microphones 432 that are physically offset from one another to provide for stereo sound detection. The sensor 430 is in communication with the controller 440 such that the controller 440 is operable to detect the characteristics (e.g., the frequency and/or amplitude) of the sound based upon information received from the microphones 432.

As will be appreciated by those skilled in the art, the sound emitted by the speakers 471 is modulated by the pipe 472 into which the sound is emitted. The type and degree of modulation depends in part upon the characteristics of the pipe 472, including which if any of the apertures 473 are being blocked by the protrusion 425 of the corresponding flap 424. Thus, the amplitude and/or frequency of the sound detected by the sensor 430 will be different when the one key $\mathbf{460}_1$ is depressed than when the four key $\mathbf{460}_4$ is depressed. Additionally, with each speaker 471 emitting a unique tone, the characteristics of the sound detected when an aperture of one pipe 472 is unblocked will be different from the characteristics of the sound detected when a corresponding aperture of another pipe 472 is unblocked.

The provision of stereo microphones 432 may further aid in distinguishing between the sounds resulting from depression of different keys 460. For example, when the flap 424 corresponding to the two key $\mathbf{460}_2$ is open, the sound detected by the upper microphone 432 will be of a greater amplitude than the sound detected by the lower microphone 432. Conversely, when the flap 424 corresponding to the zero key $\mathbf{460}_0$ is open, the sound detected by the lower microphone 432 will be of a greater amplitude than the sound detected by the upper microphone 432. As will be appreciated, the sensor 430 may include a greater number of microphones 432 to further increase the sensitivity of the sensor 430 to differences in sound amplitude. As one example, the sensor 430 may include the same number of microphones 432 as there are apertures 473, and each microphone 432 may be mounted behind a corresponding and respective one of the apertures 473 such that the sound detected by each speaker is greatest when the flap 424 covering the corresponding aperture 473 is in its open position.

As should be evident from the foregoing, the characteristics (e.g., frequency and/or amplitude) of the sound detected by the sensor 430 will vary based upon which keys 460 are being depressed. The controller 440 is capable of analyzing the information received from the sensor 430 to determine the sequence of keys 460 that have been pressed to generate the corresponding sequence of sounds detected by the sensor 430, and is thus capable of determining the inputted code based upon information received from the sensor 430.

Figure 13:
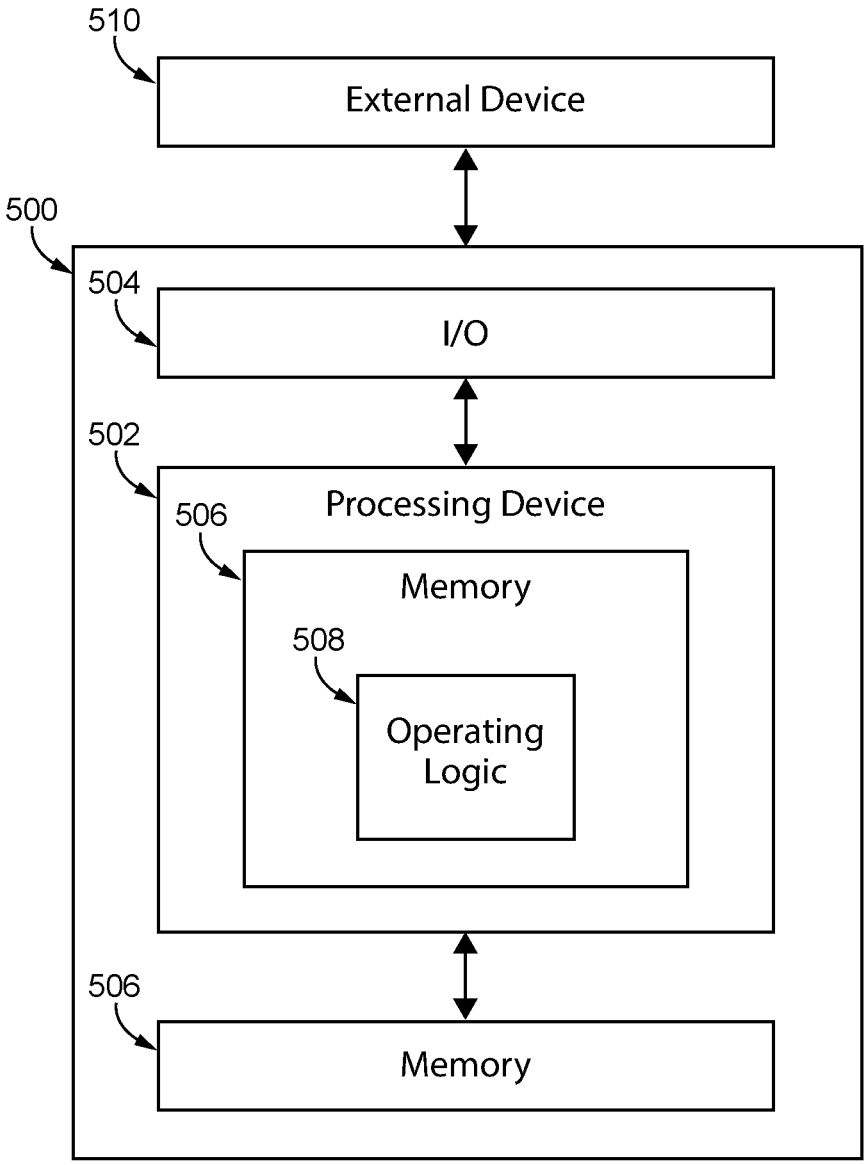
FIG. 13 is a schematic block diagram of a computing device.

Referring now to FIG. 13, a simplified block diagram of at least one embodiment of a computing device 500 is shown. The illustrative computing device 500 depicts at least one embodiment of an access control device, keypad assembly, joystick assembly, or controller that may be utilized in connection with the access control device 100, keypad assemblies 200, 400 joystick assembly 300, and/or controllers 140, 240, 340, 440 described above.

Depending on the particular embodiment, the computing device 500 may be embodied as a server, desktop computer, laptop computer, tablet computer, notebook, netbook, Ultrabook™ mobile computing device, cellular phone, smartphone, wearable computing device, personal digital assistant, Internet of Things (IoT) device, reader device, access control device, control panel, processing system, router, gateway, and/or any other computing, processing, and/or communication device capable of performing the functions described herein.

The computing device 500 includes a processing device 502 that executes algorithms and/or processes data in accordance with operating logic 508, an input/output device 504 that enables communication between the computing device 500 and one or more external devices 510, and memory 506 which stores, for example, data received from the external device 510 via the input/output device 504.

The input/output device 504 allows the computing device 500 to communicate with the external device 510. For example, the input/output device 504 may include a transceiver, a network adapter, a network card, an interface, one or more communication ports (e.g., a USB port, serial port, parallel port, an analog port, a digital port, VGA, DVI, HDMI, FireWire, CAT 5, or any other type of communication port or interface), and/or other communication circuitry. Communication circuitry may be configured to use any one or more communication technologies (e.g., wireless or wired communications) and associated protocols (e.g., Ethernet, Bluetooth®, Bluetooth Low Energy (BLE), Wi-Fi®, WiMAX, etc.) to effect such communication depending on the particular computing device 500. The input/output device 504 may include hardware, software, and/or firmware suitable for performing the techniques described herein.

The external device 510 may be any type of device that allows data to be inputted or outputted from the computing device 500. For example, in various embodiments, the external device 510 may be embodied as the access control device 100, the actuator 130, the keypad assemblies 200, 400 joystick assembly 300, and/or the controllers 140, 240, 340, 440. Further, in some embodiments, the external device 510 may be embodied as another computing device, switch, diagnostic tool, controller, printer, display, alarm, peripheral device (e.g., keyboard, mouse, touch screen display, etc.), and/or any other computing, processing, and/or communication device capable of performing the functions described herein. Furthermore, in some embodiments, it should be appreciated that the external device 510 may be integrated into the computing device 500.

The processing device 502 may be embodied as any type of processor(s) capable of performing the functions described herein. In particular, the processing device 502 may be embodied as one or more single or multi-core processors, microcontrollers, or other processor or processing/controlling circuits. For example, in some embodiments, the processing device 502 may include or be embodied as an arithmetic logic unit (ALU), central processing unit (CPU), digital signal processor (DSP), and/or another suitable processor(s). The processing device 502 may be a programmable type, a dedicated hardwired state machine, or a combination thereof. Processing devices 502 with multiple processing units may utilize distributed, pipelined, and/or parallel processing in various embodiments. Further, the processing device 502 may be dedicated to performance of just the operations described herein, or may be utilized in one or more additional applications. In the illustrative embodiment, the processing device 502 is of a programmable variety that executes algorithms and/or processes data in accordance with operating logic 508 as defined by programming instructions (such as software or firmware) stored in memory 506. Additionally or alternatively, the operating logic 508 for processing device 502 may be at least partially defined by hardwired logic or other hardware. Further, the processing device 502 may include one or more components of any type suitable to process the signals received from input/output device 504 or from other components or devices and to provide desired output signals. Such components may include digital circuitry, analog circuitry, or a combination thereof.

The memory 506 may be of one or more types of non-transitory computer-readable media, such as a solid-state memory, electromagnetic memory, optical memory, or a combination thereof. Furthermore, the memory 506 may be volatile and/or nonvolatile and, in some embodiments, some or all of the memory 506 may be of a portable variety, such as a disk, tape, memory stick, cartridge, and/or other suitable portable memory. In operation, the memory 506 may store various data and software used during operation of the computing device 500 such as operating systems, applications, programs, libraries, and drivers. It should be appreciated that the memory 506 may store data that is manipulated by the operating logic 508 of processing device 502, such as, for example, data representative of signals received from and/or sent to the input/output device 504 in addition to or in lieu of storing programming instructions defining operating logic 508. As illustrated, the memory 506 may be included with the processing device 502 and/or coupled to the processing device 502 depending on the particular embodiment. For example, in some embodiments, the processing device 502, the memory 506, and/or other components of the computing device 500 may form a portion of a system-on-a-chip (SoC) and be incorporated on a single integrated circuit chip.

In some embodiments, various components of the computing device 500 (e.g., the processing device 502 and the memory 506) may be communicatively coupled via an input/output subsystem, which may be embodied as circuitry and/or components to facilitate input/output operations with the processing device 502, the memory 506, and other components of the computing device 500. For example, the input/output subsystem may be embodied as, or otherwise include, memory controller hubs, input/output control hubs, firmware devices, communication links (i.e., point-to-point links, bus links, wires, cables, light guides, printed circuit board traces, etc.) and/or other components and subsystems to facilitate the input/output operations.

The computing device 500 may include other or additional components, such as those commonly found in a typical computing device (e.g., various input/output devices and/or other components), in other embodiments. It should be further appreciated that one or more of the components of the computing device 500 described herein may be distributed across multiple computing devices. In other words, the techniques described herein may be employed by a computing system that includes one or more computing devices. Additionally, although only a single processing device 502, I/O device 504, and memory 506 are illustratively shown in FIG. 5, it should be appreciated that a particular computing device 500 may include multiple processing devices 502, I/O devices 504, and/or memories 506 in other embodiments. Further, in some embodiments, more than one external device 510 may be in communication with the computing device 500.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An access control device, comprising:

a housing;

an electronic actuator operable to transition the access control device between an unlocked condition and a locked condition;

a sensor mounted in the housing for movement between a home position and a plurality of additional positions, wherein the sensor comprises one of an accelerometer or a gyrometer;

a plurality of keys movably mounted to the housing, wherein each key is operable to move the sensor from the home position to a corresponding and respective one of the plurality of additional positions; and a controller in communication with the sensor and the electronic actuator, wherein the controller is configured to determine an inputted code based upon information received from the sensor, to compare the inputted code to an authorized code, and to issue an unlock command in response to the inputted code matching the authorized code; and wherein the electronic actuator is configured to transition the access control device from the locked condition to the unlocked condition in response to receiving the unlock command.

2. The access control device of claim 1, wherein the sensor is biased toward the home position.

3. The access control device of claim 1, wherein the sensor comprises the gyrometer, and wherein each of the additional positions is a corresponding and respective pivoted position of the gyrometer.

4. The access control device of claim 3, wherein the gyrometer is a multi-axis gyrometer operable to sense pivoting of the gyrometer about each of a first axis and a second axis arranged perpendicular to the first axis;

wherein a first of the pivoted positions of the gyrometer is pivoted about the first axis relative to the home position; and wherein a second of the pivoted positions of the gyrometer is pivoted about the second axis relative to the home position.

5. The access control device of claim 1, wherein the sensor is mounted to a pivot pad, and wherein the pivot pad is pivotably coupled to a mounting plate.

6. The access control device of claim 1, further comprising:

a bolt mechanism including a bolt having an extended position and a retracted position; and a manual actuator movably mounted to the housing and operably connected with the bolt mechanism;

wherein in the unlocked condition, the manual actuator is operable to move the bolt from the extended position to the retracted position;

wherein in the locked condition, the manual actuator is inoperable to move the bolt from the extended position to the retracted position; and wherein the electronic actuator is configured to selectively permit the manual actuator to move the bolt from the extended position to the retracted position by moving a locking member from a locking position to an unlocking position.

7. The access control device of claim 1, further comprising a bolt mechanism including a bolt having an extended position and a retracted position; and wherein the electronic actuator is configured to transition the access control device between the unlocked condition and the locked condition by moving the bolt between the extended position and the retracted position.

8. An access control device, comprising:

a mounting plate;

a pivot pad pivotably mounted to the mounting plate, wherein the pivot pad is biased to a home position and is operable to pivot to each of a plurality of pivoted positions;

a sensor mounted to the pivot pad such that the sensor moves with the pivot pad, wherein the sensor is configured to generate information relating to an orientation of the sensor;

a user input device operable to move the pivot pad from the home position to each of the plurality of pivoted positions, thereby altering the orientation of the sensor;

a controller in communication with the sensor, wherein the controller is configured to determine an inputted code based upon information received from the sensor, to compare the inputted code to an authorized code, and to issue an unlock command in response to the comparing; and an electronic actuator in communication with the controller, wherein the electronic actuator is configured to transition the access control device from a locked state to an unlocked state in response to the unlock command.

9. The access control device of claim 8, wherein the user input device comprises a plurality of keys, and wherein each key is operable to place the pivot pad in a corresponding and respective pivoted position of the plurality of pivoted positions.

10. The access control device of claim 9, further comprising a housing including a plurality of openings;

wherein each of the keys is movably seated in a corresponding and respective one of the openings; and wherein each key is biased toward a projected position and is movable to a depressed position in which the key contacts the pivot pad and places the pivot pad in the corresponding and respective pivoted position.

11. The access control device of claim 10, wherein each key includes a body portion extending through the opening and a base having a greater width dimension than the opening such that the key cannot be pulled through the opening.

12. The access control device of claim 10, wherein the housing and the plurality of keys are constructed of metal.

13. The access control device of claim 8, wherein the pivot pad is pivotably mounted to the mounting plate via a ball and socket joint such that the pivot pad is operable to pivot about each of a first axis and a second axis perpendicular to the first axis.

14. The access control device of claim 8, wherein the access control device is a door lock having a locking member; and wherein the electronic actuator is configured to transition the door lock from the locked state to the unlocked state by moving the locking member from a locking position to an unlocking position.

15. A keypad assembly, comprising:

a housing;

a pipe mounted in the housing, the pipe including a plurality of apertures;

a speaker mounted in the housing and configured to emit a sound into the pipe;

a sensor mounted in the housing, the sensor including at least one microphone operable to detect sound;

a plurality of keys movably mounted to the housing, wherein each key is associated with a corresponding and respective aperture of the plurality of apertures and is movable between a first position in which the corresponding and respective aperture is closed and a second position in which the corresponding and respective aperture is open to thereby modulate the sound detected by the sensor; and a controller in communication with the sensor, wherein the controller is configured to determine an inputted code based upon information received from the sensor, to compare the inputted code to an authorized code, and to issue a command in response to the comparing.

16. The keypad assembly of claim 15, further comprising a flex pad including a plurality of resilient flaps; and wherein each resilient flap is associated with a corresponding and respective key of the plurality of keys and is configured to block and unblock the aperture corresponding to the corresponding and respective key in response to movement of the corresponding and respective key between the first position and the second position thereof.

17. The keypad assembly of claim 15, wherein the sensor includes a plurality of the microphones;

wherein the plurality of microphones are spaced apart from one another; and wherein the controller is configured to determine the inputted code based in part upon differences in sound amplitudes detected by the plurality of speakers.

18. The keypad assembly of claim 15, further comprising a plurality of the pipes and a plurality of the speakers, and wherein each speaker is mounted in a corresponding and respective pipe.

19. The keypad assembly of claim 18, wherein each speaker is configured to emit sound of a different frequency.

20. An access control device comprising (Original) The keypad assembly of claim 15, the access control device having a locked state and an unlocked state, wherein the access control device is configured to transition from the locked state to the unlocked state in response to an unlock command, and wherein the controller is configured to transmit the unlock command based in response to the inputted code matching the authorized code.

* * * * *